United States Patent [19]

Sills

[11] Patent Number: 4,932,144

[45] Date of Patent: Jun. 12, 1990

[54] REMOTE UNDERWATER EXCAVATOR AND SAMPLER

[75] Inventor: Nicholas V. Sills, Petts Wood, United Kingdom

[73] Assignee: Consortium Resource Management Limited, Bridge of Don Aberdeen, United Kingdom

[21] Appl. No.: 230,380

[22] PCT Filed: Feb. 10, 1987

[86] PCT No.: PCT/GB87/00099

§ 371 Date: Aug. 9, 1988

§ 102(e) Date: Aug. 9, 1988

[87] PCT Pub. No.: WO87/04743

PCT Pub. Date: Aug. 13, 1987

[30] Foreign Application Priority Data

Feb. 10, 1986 [GB] United Kingdom ..... 8603189

[51] Int. Cl.[5] ..... E02F 3/88

[52] U.S. Cl. ..... 37/78; 37/75; 73/864.23; 299/8; 415/211.1

[58] Field of Search ..... 299/9, 8; 37/75, 77, 37/78; 405/73, 79, 226, 248, 22, 23, 26, 62, 163; 73/864.23, 864.31, 864.33, 864.41; 415/211.2

[56] References Cited

U.S. PATENT DOCUMENTS

| | | | |
|---|---|---|---|
| 4,073,078 | 2/1978 | Leitz | 37/77 |
| 4,073,079 | 2/1978 | Klinefelter | 37/78 |
| 4,386,473 | 6/1983 | Amann et al. | 73/864.41 X |
| 4,694,645 | 9/1987 | Flyborg et al. | 415/211.2 X |
| 4,761,096 | 8/1988 | Lin | 405/226 X |

FOREIGN PATENT DOCUMENTS

| | | | |
|---|---|---|---|
| 134312 | 3/1985 | European Pat. Off. . | |
| 2942302 | 4/1981 | Fed. Rep. of Germany | 299/9 |
| 224726 | 12/1984 | Japan | 405/226 |

*Primary Examiner*—Jerome W. Massie, IV
*Assistant Examiner*—David J. Bagnell
*Attorney, Agent, or Firm*—Fitch, Even, Tabin & Flannery

[57] ABSTRACT

An underwater excavator in which when energized by a supply of hydraulic oil or other means a propeller is set in motion with water being drawn through a water intake into a cylindrical tube and expelled at the water outlet to create a flow of water of sufficient volume and velocity to blow away seabed materials. Thrust and torque are counteracted by the suction force developed at the water intake. Optional filter nets or sieves may be fixed to a foot of the machine to capture samples of the material washed out of the seabed.

9 Claims, 1 Drawing Sheet

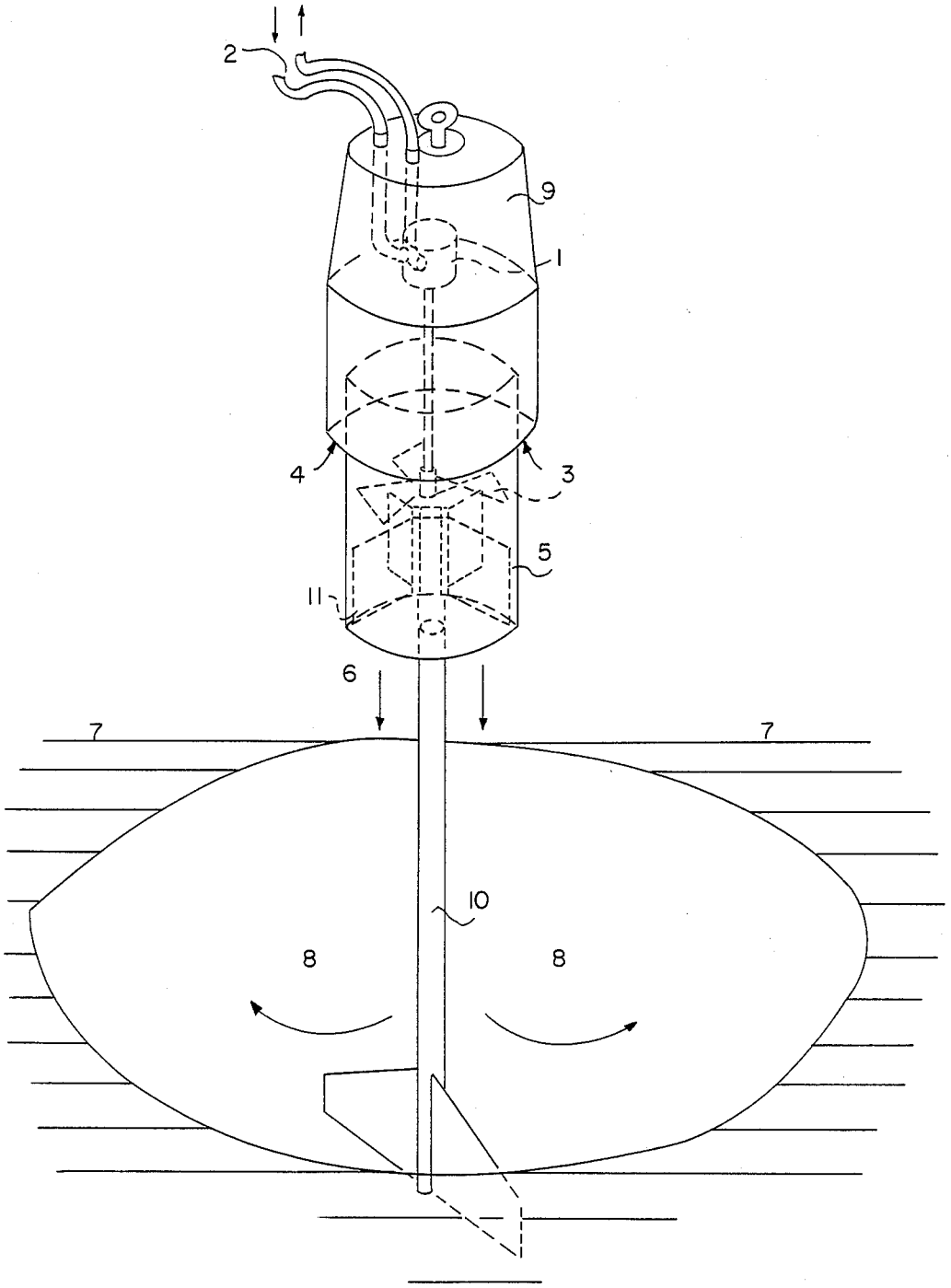
2
9
1
4
3
5
11
6
7
7
10
8
8

REMOTE UNDERWATER EXCAVATOR AND SAMPLER

This invention relates to a method of excavating and sampling materials under any depth of water utilizing a machine capable of generating and directing a water column.

BACKGROUND OF THE INVENTION

Present methods of underwater excavation using a water column rely on diverting the water flow from a ship's propeller, vertically downwards through a tube and washing a crater in the river, lake or seabed. This system cannot be used to sample the washed out materials or outside shallow water or where access for the ship is not possible. The present invention concerns an excavation machine that can be deployed remotely from a ship or other vehicle in any depth of water and having an additional capability of sampling washed out materials.

SUMMARY OF THE INVENTION

According to the present invention there is provided a cylindrical tube through which a water column is generated by means of either a propeller or multiple venturi pipes. A water intake is fitted to the top of the tube in such a configuration as to enable the suction from the intake to oppose the thrust from the outlet thereby stabilizing the machine while in operation. When in the propeller mode, vertical vanes 11 in the water outlet act to prevent the swirling motion of the water column normally produced by a propeller so that a laminar flow of water is produced, and small deflectors can be fitted at the bottom of the vanes to oppose the torque developed by the propeller and assist preventing the machine from rotating. An anchor leg extending from the base of the machine is used to keep the machine at a fixed distance from the surface on which it is operating. Fins attached to the base of the anchor leg by sinking into the ground assist in maintaining the machine in position and when in the propeller mode also prevent the machine from rotating. Filter baskets can be attached to these fins to sample materials washed out during excavation. A buoyancy tank on top of the machine maintains the machine in an upright position. A lifting eye can be incorporated for ease of deployment and the machine can be constructed in such a way as to be easily dismantlable.

BRIEF DESCRIPTION OF THE DRAWING

A specific embodiment of the invention will now be described by way of example with reference to the accompanying drawing in FIG. 1, which is generally a perspective view of an excavator constructed in accordance with the invention.

DESCRIPTION OF THE PREFERRED EMBODIMENT

Referring to FIG. 1, when power is received by a motor 1, such as an hydraulic motor, from a power source via an umbilical connection 2, a propeller 3 is set in motion, water is drawn in through a water intake 4, then through a cylindrical tube 5 and expelled as a water column at a water outlet 6. The suction force developed at the water intake helps to oppose the thrust developed at the water outlet by the water column and keeps the machine in contact with the seabed 7. The speed of the propeller and thereby the velocity of the water column jet can be controlled from the surface using a valve set in the umbilical. It is thereby possible at an illustrative velocity of say five meters per second for the water column to be sufficiently powerful to mobilize and displace solid materials such as sand, gravel, pebbles and rocks from underneath the invention to a radius of at least two meters. As excavation continues a crater 8 is formed and continues to deepen until a steady state is achieved, whereby excavation of the crater is equalized by infill of the crater's sides. Heavy objects such as large rocks, or dense materials, such as metals, will generally remain in the crater and can be collected separately, for example, by divers. The machine is maintained in an upright position during deployment by use of a buoyancy tank 9, the buoyancy of which is alterable to make the machine negatively, neutrally or positively buoyant, and the machine is kept on location away from the seabed over which it is being deployed by means of an anchor 10.

I claim:

1. A remote underwater excavator comprising a tube having a water outlet, a propeller mounted in the tube, means for energizing the propeller, the propeller when energized underwater producing a flow of water through the tube and out of the outlet having no significant hydrostatic head but having sufficient volume and velocity to carry away seabed materials on the flow thus produced, and intake means to the tube to draw water into the tube in the opposite direction to the discharge from the outlet to stabilize the tube when in use.

2. A remote underwater excavator as claimed in claim 1 wherein an annulus shaped intake external to and parallel to the flow of water in the tube produces suction to counteract the thrust produced by the flow of water.

3. A remote underwater excavator as claimed in claim 1 wherein vanes are set in the water outlet to counteract torque developed by the propeller.

4. A remote underwater excavator as claimed in claim 1 wherein a buoyancy tank mounted above the tube maintains the excavator in an upright posture even when the excavator is not energized.

5. A remote underwater excavator as claimed in claim 4 wherein a rigid leg and foot anchor the excavator in position on the underwater bottom by friction and weight.

6. A remote underwater excavator as claimed in claim 5 wherein the buoyancy tank and anchor will maintain the excavator at a constant altitude above the underwater bottom by the excavator descending as the bottom is excavated beneath it.

7. A remote underwater excavator as claimed in claim 4 wherein the buoyancy of the buoyancy tank is alterable to make the excavator negatively, neutrally or positively buoyant.

8. A remote underwater excavator comprising a tube having a water outlet, a propeller mounted in the tube, means for energizing the propeller, vanes set in the water outlet to counteract torque developed by the propeller, the propeller when energized underwater producing a flow of water through the tube and out of the outlet having no significant hydrostatic head but having sufficient volume and velocity to carry away seabed materials on the flow thus produced, and intake means to the tube to draw water into the tube in the opposite direction to the discharge from the outlet to stabilize the tube when in use.

9. A remote underwater excavator comprising a tube having a water outlet, a propeller mounted in the tube, means for energizing the propeller, the propeller when energized underwater producing a flow of water through the tube and out of the outlet having no significant hydrostatic head but having sufficient volume and velocity to carry away seabed materials on the flow thus produced, and an annulus shaped intake external to and parallel to the flow of water in the tube for producing suction to counteract the thrust produced by the flow of water.

* * * * *